US011504970B2

(12) United States Patent
Bonjoch Roma et al.

(10) Patent No.: US 11,504,970 B2
(45) Date of Patent: Nov. 22, 2022

(54) PRINTING FLUID COLLECTORS

(71) Applicant: Hewlett-Packard Development Company, L.P., Spring, TX (US)

(72) Inventors: Ignasi Bonjoch Roma, Sant Cugat del Valles (ES); Oscar Moya Rojo, Sant Cugat del Valles (ES); Josep Maria Bel Calavia, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/264,024

(22) PCT Filed: Mar. 13, 2019

(86) PCT No.: PCT/US2019/022128
§ 371 (c)(1),
(2) Date: Jan. 28, 2021

(87) PCT Pub. No.: WO2020/185228
PCT Pub. Date: Sep. 17, 2020

(65) Prior Publication Data

US 2022/0001669 A1 Jan. 6, 2022

(51) Int. Cl.

| | |
|---|---|
| ***B41J 2/17*** | (2006.01) |
| ***B41J 29/17*** | (2006.01) |
| ***B41J 11/00*** | (2006.01) |

(52) U.S. Cl.
CPC ..... *B41J 2/1721* (2013.01); *B41J 11/007* (2013.01); *B41J 29/17* (2013.01)

(58) Field of Classification Search
CPC ... B41J 2/0057; B41J 2002/012; B41J 2/1721
See application file for complete search history.

(56) References Cited

U.S. PATENT DOCUMENTS

| | | | |
|---|---|---|---|
| 4,811,035 | A | 3/1989 | Huliba et al. |
| 7,524,050 | B2 | 4/2009 | Baker et al. |
| 7,669,959 | B2 | 3/2010 | Sekimoto et al. |
| 8,550,585 | B2 | 10/2013 | Tsuchiya |

(Continued)

FOREIGN PATENT DOCUMENTS

| | | |
|---|---|---|
| CN | 208148835 | 11/2018 |
| JP | 2006297659 | 11/2006 |

(Continued)

OTHER PUBLICATIONS

Kimura et al., MachineTranslationofJP-2011161690-A, 2011 (Year: 2011).*

*Primary Examiner* — Scott A Richmond
(74) *Attorney, Agent, or Firm* — HP Inc. Patent Department

(57) ABSTRACT

A printing fluid collector is described. In one example, the collector comprises a conveying mechanism for collecting printing fluid ejected from a printing fluid dispenser, and a connecting means for connecting the conveying mechanism to a printing system in an orientation such that the conveying mechanism is to collect printing fluid ejected from the printing fluid dispenser and convey the printing fluid in a direction which is substantially perpendicular to a direction of movement of a print medium along a print medium path.

15 Claims, 5 Drawing Sheets

(56) References Cited

U.S. PATENT DOCUMENTS

| | | | | |
|---|---|---|---|---|
| 2007/0229585 | A1 | 10/2007 | Komatsu | |
| 2010/0149290 | A1* | 6/2010 | Misumi | B41J 2/17506 347/85 |
| 2011/0150541 | A1* | 6/2011 | Michibata | G03G 15/161 399/313 |
| 2013/0127958 | A1 | 5/2013 | Plummer | |
| 2017/0113476 | A1* | 4/2017 | Hara | B41J 29/17 |
| 2018/0009238 | A1* | 1/2018 | Zuza Irurueta | B41J 2/1721 |
| 2019/0176474 | A1* | 6/2019 | Nakamura | B41J 2/185 |

FOREIGN PATENT DOCUMENTS

| | | | |
|---|---|---|---|
| JP | 2011156781 | | 8/2011 |
| JP | 2011161690 | A * | 8/2011 |
| WO | WO-2002036347 | | 5/2002 |
| WO | WO-2005007415 | | 1/2005 |

* cited by examiner

PRINTING FLUID COLLECTORS

BACKGROUND

Printing systems may be arranged to transport a print medium along a media path and allow for a printing fluid to be deposited onto the print medium. A media transport system may be used to transport the print medium along the print media path. The media transport system may comprise a set of driven rollers or a belt. Printing fluid may be deposited onto the print medium using fluid ejection technologies. A variety of materials, porous or non-porous may be used as print media in printing systems, for example papers, cards, plastics and textiles.

Different printing systems may be used for printing on materials of different porosity. Depending upon the porosity of a print media, printing fluid may pass through the print media.

BRIEF DESCRIPTION OF THE DRAWINGS

Various features of the present disclosure will be apparent from the detailed description which follows, taken in conjunction with the accompanying drawings, which together illustrate features of the present disclosure, and wherein.

DETAILED DESCRIPTION

During a print operation, printing fluid deposited on a print medium penetrates the print medium to a degree which is dependent on the print medium's porosity. When a print medium having a sufficiently high porosity is used, a portion of the printing fluid may permeate the print medium completely, causing at least a portion of the printing fluid to pass through the print medium resulting in leakage of the printing fluid on to a surface below the print medium, for example.

Printing fluid which leaks through the print medium may disintegrate to form an aerosol. Such leakage and aerosol generation of the printing fluid may negatively affect the printing process. For example, the print media itself may become stained by the aerosol generated, thereby reducing print quality. In another example, components of the printing system may become stained. Further, excess printing fluid may clog mechanical components and affect electronic circuits within the printing system, for example.

These and other leakage-related issues may subsequently involve cleaning, servicing or replacement of components to be carried out, thereby increasing expense, printing system downtime and user or service intervention.

In order to reduce the effect of printing fluid staining or impeding the print medium or printing system components after permeating a porous medium, a printing fluid collector may be installed. A printing fluid collector may be arranged to collect printing fluid that permeates the print medium. For example, a printing fluid collector may be arranged, in use, to be underneath the print area or print medium, e.g. positioned below the print medium path or the print area. In certain cases, a printing fluid collector may be provided over a platen or even replace the platen of the print medium path.

The printing fluid collector disclosed herein provides an improvement such that it may not be frequently replaced or involve manual cleaning when compared to, for example, static foams. The systems having a printing fluid collector disclosed herein also provide the improvement of reduced risk of contamination of the underside of the print medium when compared to, for example, static foams. Additionally, the printing fluid collector disclosed herein may be placed much closer to the print medium when compared to, for example, gutter systems or static foams, thereby reducing the distance of travel of the printing fluid; a higher distance of travel makes the printing fluid more likely to disintegrate and form an aerosol resulting in other contamination issues.

The printing fluid collector disclosed herein may also take up less space in the printing system and also has the improvement of reducing the likelihood of printing fluid clogging the collector when compared to gutter systems, for example.

Figure 1A:
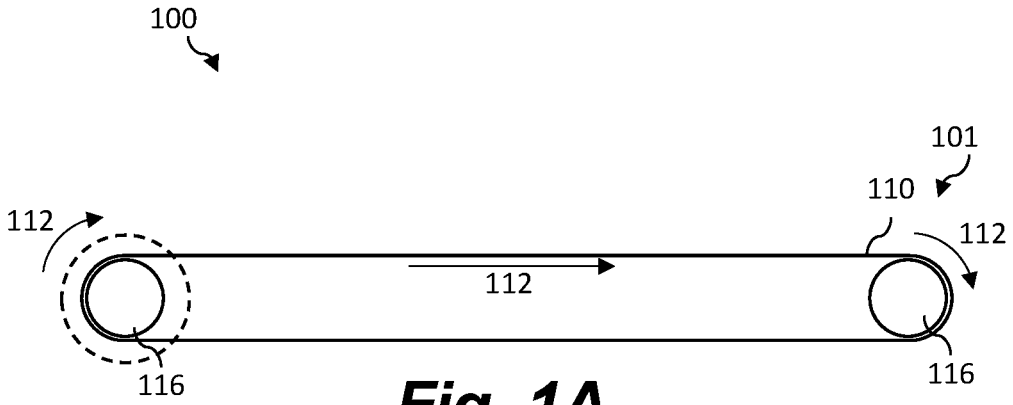
FIG. 1A is a schematic drawing showing a side view of a printing fluid collector according to an example.
Figure 1B:
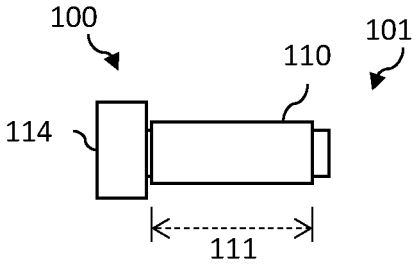
FIG. 1B is a schematic drawing showing an end view of the printing fluid collector.
Figure 1C:
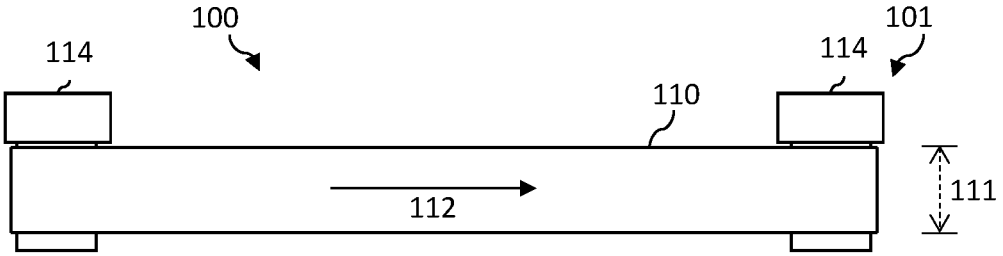
FIG. 1C is a schematic drawing showing a plan view of the printing fluid collector.

FIGS. 1A-C show, respectively, a side view, an end view and a plan view of a printing fluid collector 100 according to an example. The term "printing fluid" as used herein refers to any fluid suitable for printing, including, amongst others a printing liquid, a gloss, a varnish, a dye and a coating. The printing fluid collector 100 includes a conveying mechanism (herein referred to as a "print fluid conveyor") 101 comprising a belt 110 and conveyor belt rollers 116. In other examples, the print fluid conveyor 101 may comprise another type of conveyor system, such as a roller conveyor system, flexible conveyor system etc. In some examples, the print fluid conveyor may include other components including, but not limited to, platens, rollers, cylinders, or belts and nips.

In this example, the conveyor rollers 116 of the print fluid conveyor 101 drive the belt 110 round in a circuit. In the case where a belt conveyor system is employed, the belt may be composed of any material which is capable of collecting printing fluid (e.g. is not porous with respect to the printing fluid). In some examples, the belt may be composed of a material which repels the printing fluid in order to allow for easier cleaning of the belt or of a material which is coated with a repellent to repel the printing fluid. In other examples, the belt may be composed of a plastic or elastic material. In some examples, the belt may be composed of a material which temporarily retains the printing fluid. In one case, the belt material or coating on the belt prevents the printing fluid forming an aerosol once it is in contact with the belt. Therefore, the belt may comprise an absorbent material, an adsorbent material or a combination of both.

The printing fluid collector 100 comprises connecting means 114 for connecting the print fluid conveyor 101 to a printing system. The connecting means 114 may comprise a mechanical coupling of the print fluid conveyor 101 to a printing system, such that the print fluid conveyor 101 is securely retained and in contact with components of the printing system arranged to receive the mechanical coupling. The connecting means 114 connects the print fluid conveyor 101 to a printing system in an orientation such that the conveyor belt 110 conveys the printing fluid in a direction 112 perpendicular to the direction of a print medium along a print medium path.

Figure 2A:
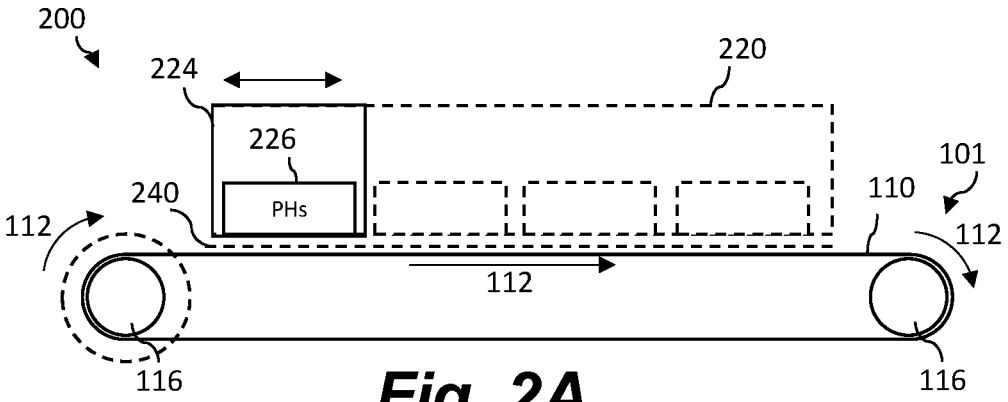
FIG. 2A is a schematic drawing showing a side view of a printing system according to a first example.
Figure 2B:
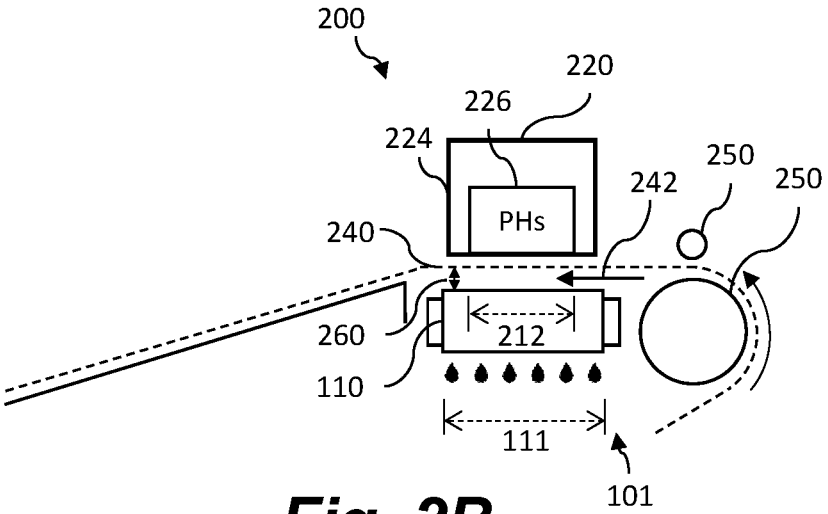
FIG. 2B is a side view showing a printing fluid collector in a printing system according to FIG. 2A.

In this example, the connecting means 114 is disposed on a side of the conveyor belt 110. In other examples the connecting means 114 may be disposed at a different location. The connecting means 114 may comprise clamps for example, or another mechanism which enables the printing fluid collector 100 to be removably connected to a printing system. The conveyor belt 110 moves in a circuit with the portion of the belt 110 moving in the direction indicated by the arrows 112 during operation. However, in some examples it is also possible for the conveyor belt 110 to be moved in the reverse direction, if desired. FIGS. 2A and 2B show a side view and an end view, respectively, of a first example of a printing system 200 comprising the printing fluid collector 100 described above. In use, a printing medium is conveyed along a print medium path 240. The printing system 200 may comprise any device suitable for performing an additive manufacturing process, and which may include but not be limited to systems for additive manufacturing in two-dimensions and/or three-dimensions.

The printing system 200 comprises a conveying mechanism (herein referred to as a "print medium conveyor" 250 for conveying the print medium in a direction 242 along the print medium path 240. The print medium conveyor 250 may comprise any mechanisms suitable for conveying a print medium along a print medium path 240, including but not limited to platens, rollers, cylinders, belts or nips.

The printing system 200 includes a printing fluid dispenser, which may take the form of a printing carriage 224 movable along a width of the print medium path 240 or of a fixed carriage 220 spanning the whole width of the print medium path 240, for example. The printing fluid dispenser may comprise print heads 226 including nozzles for ejecting printing fluid and depositing it onto a print medium along the print medium path 240. The configuration of the carriage and the print heads may vary based on the type of printing system and the type of printing fluid used.

As shown in FIGS. 2A and 2B, the printing fluid dispenser is disposed such that upon ejection of printing fluid, the printing fluid is deposited on the print medium in a print area (e.g. area to which printing fluid is deposited or ejected) along a print medium path 240. Printing fluid which passes through the print medium is then collected by the printing fluid collector 100. As shown, the printing fluid collector 100 is disposed on the opposite side of the print medium path 240 to the printing fluid dispenser such that, during a print operation, printing fluid ejected from the printing fluid dispenser which completely permeates a porous print medium on the print medium path 240 is collected on the conveyor belt 110 and conveyed in a direction 122 substantially perpendicular to a direction 242 of movement of the print medium along the print medium path 240. The print medium path 240 is thus disposed between the printing fluid dispenser and the conveyor belt 110 and is also spaced apart from the conveyor belt 110 by a non-zero distance 260.

The printing fluid which is collected on the conveyor belt 110 is thus removed from the printing area. The continuous removal of the printing fluid by the conveyor belt 110 from the print area reduces the likelihood of staining of the print medium. This is because for example, removing the printing fluid from the printing area inhibits aerosols of the printing fluid contacting the print medium.

The printing fluid is collected and conveyed by the print fluid conveyor 101 in a direction 112 substantially perpendicular to direction 242 of the print medium along the print medium path 240 (along the same direction that the print area length extends e.g. along the direction of movement of the printing carriage 224, in the case that a moveable printing carriage is used), thus allowing the conveyor belt 110 to have a width 111 which is independent of the print medium or print medium path 240. This in turn allows the conveyor belt 110 to be made with a relatively small width 111. The width 111 of the conveyor belt 110 in a direction perpendicular to the direction of movement of the print fluid conveyor 101 may be selected such that it is equal to or slightly greater than the corresponding length 212 of the printing area of the printing fluid dispenser employed in the printing system 200. The width 111 of the conveyor belt may be between 5 mm and 400 mm. In certain cases, the width 111 may be between 5 mm and 50 mm, or may be between 300 mm and 400 mm depending on the size of the printing system. In one case, the width 111 of the conveyor belt is less than two times, less than 1.5 times, less than 1.3 times, or less than 1.1 times the length 212 of the print area in a direction 242 of movement of the print medium along a print medium path 240. The dimensions of the belt 110 having a width 111 as described herein allows for the print fluid conveyor 101 to be made relatively small. The dimensions of the conveyor belt 110 are to be suitable for the printing system used and may vary depending on the dimensions of the printing fluid dispenser of the printing system 200.

The conveyor belt 110 may be made at a thickness suitable for carrying printing fluid. The belt 110 does not support a printing medium, and thus it may be much thinner compared to belts which are used in printing systems to support a print medium. Using a thin belt may reduce manufacturing costs and allow for the printing fluid collector 100 to be made much smaller, thereby using less space in the printing system.

As mentioned, the conveyor belt 110 is disposed apart from the print medium path by a distance 260 from the print medium during a print operation. Staining of the underside of the print medium with the printing fluid on the printing fluid collector 100 can thus be inhibited or prevented.

Further, the belt 110 may continuously remove the printing fluid during operation, enabling the belt 110 according to the examples described herein can be placed at a relatively small distance 260 from the print medium path 240. This may reduce travel distance of the printing fluid and suppressing aerosol generation of the printing fluid to improve print quality.

In an example, the printing medium path 240 may be spaced apart from the conveyor belt 110 by a distance 260 of less than 5 mm, less than 4 mm, less than 3 mm, less than 2 mm, or less than 1 mm. This may inhibit or prevent aerosol generation.

Figure 3A:
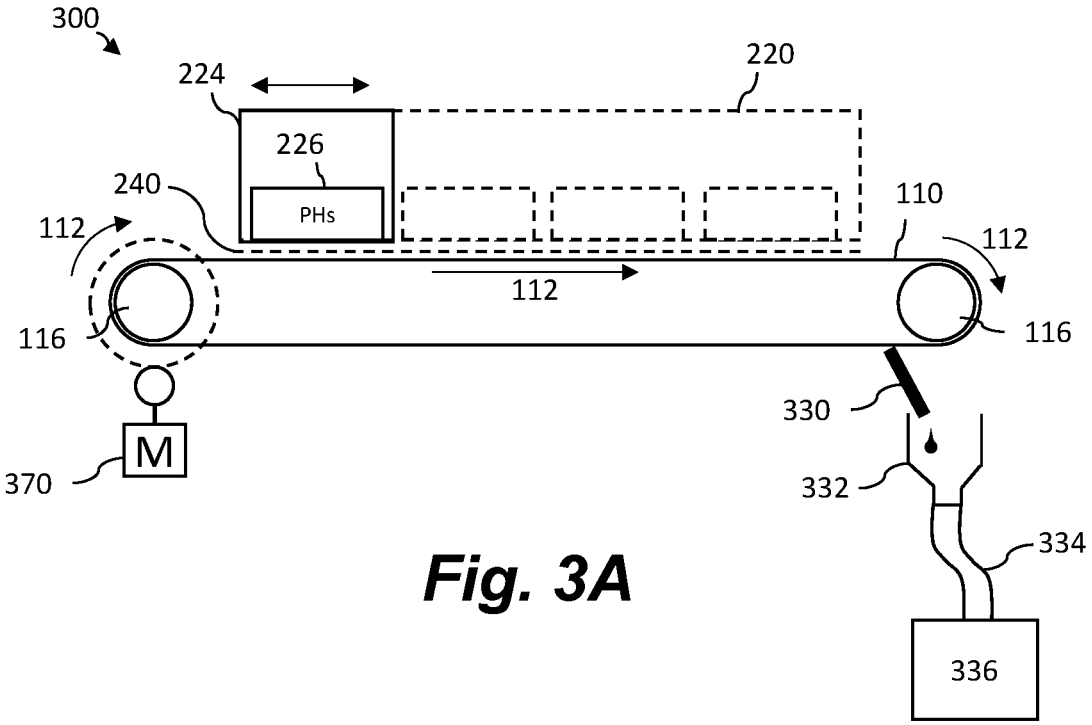
FIG. 3A is a schematic drawing showing a side view of a printing system according to a second example.
Figure 3B:
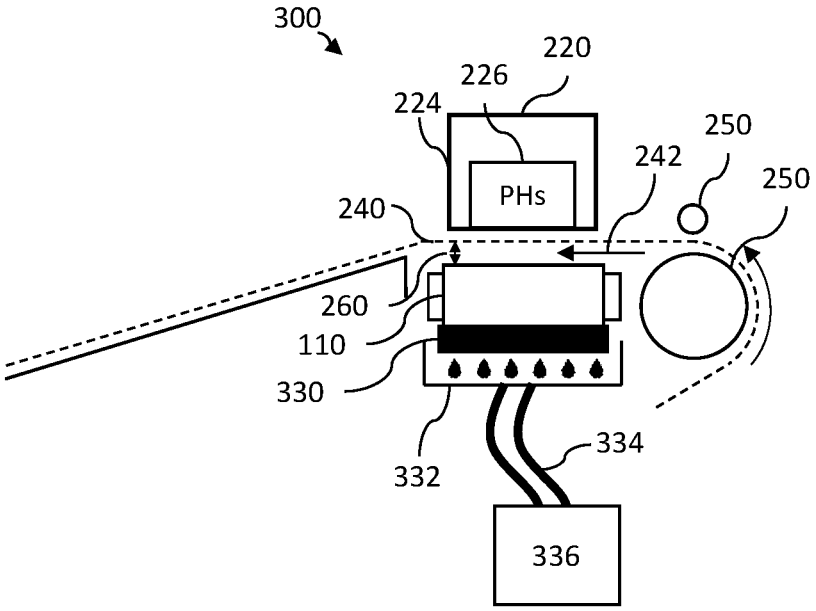
FIG. 3B is a schematic drawing showing a side view of the printing fluid collector in a printing system.
Figure 3C:
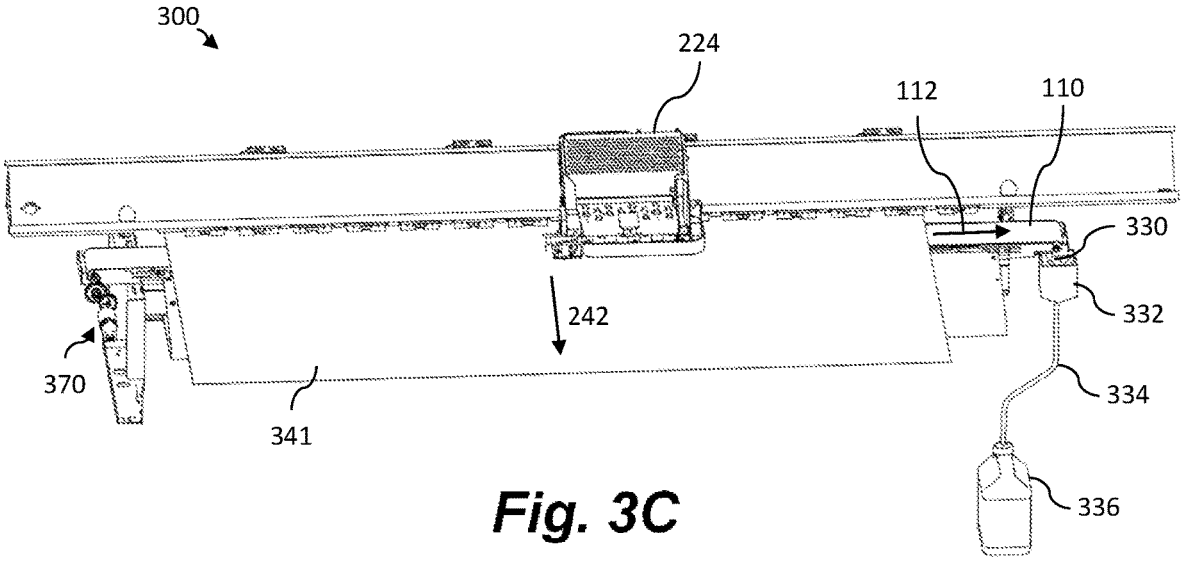
FIG. 3C is schematic drawing showing a perspective view of the printing fluid collector in a printing system.

FIG. 3A-C show respectively, a side view, an end view and a perspective view of a printing system 300 according to a second example. The printing system 300 may include some or all of the components of the example described above with reference to FIGS. 2A and 2B.

The printing system 300 comprises a printing fluid remover 330, herein referred to simply as a remover 330, disposed along the conveyor belt 110 to remove the printing fluid from the conveyor belt 110. The printing system 300 also comprises a motor or gear system 370 for driving the conveyer belt 110. In the example of FIG. 3A the printing fluid remover 330 is disposed near one end of the conveyor belt 110 and on the opposite side to the portion of the belt 110 for collecting the printing fluid. In other examples the printing fluid remover 330 may be disposed at a different location. In FIG. 3C an example of a print medium is shown 341 traversing along the print medium path 240.

The remover 300 may be a mechanical implement which is suitable for cleaning the belt 110, or for removing at least a portion of the printing fluid from the conveyor belt 110 to prevent accumulation of printing fluid on the belt 110. For example, the remover may be a scraper, a foam, a wiper or the like. In some examples, the printing fluid remover 330 is comprised of a material which, when in contact with the belt 110 has a low friction with the belt 110, hence causing minimal damage or wear to the belt 110 over time, thereby increasing the lifetime of the printing fluid collector 110. In one example, the printing fluid remover 330 may comprise a counter roller which applies pressure to the belt 110; the use of a counter roller reduces the risk of the belt 110 eroding over time.

The remover 330 allows excess printing fluid to be removed from the conveyor belt 110 between each rotation of the belt 110. This inhibits printing fluid from staining the printing system 300, and inhibits aerosols of the printing fluid from staining the print medium 241.

Additionally, as the conveyor belt 110 is spaced apart from the print medium path 240, the amount of printing fluid to be removed from the belt 110 to avoid staining of the underside of the print medium 341 is significantly less in comparison to a belt not spaced apart from and in contact with the print medium 341. As a result, just excess printing fluid may be removed by the remover 330. This may also allow the components of the remover 330 to be selected such that gentle cleaning of the belt 110 occurs, causing less stress to the belt 110, and increasing printing fluid collector 100 lifetime. Additionally, a less effective remover 330 may be employed without substantially affecting the print quality, leading to reduced costs.

Additionally, continuous removal of printing fluid from the printing fluid collector 100 allows for uninterrupted printing operations and less user or service intervention such as for cleaning or replacement of parts.

In certain examples, the printing fluid collector 100 may also comprise a printing fluid collection vessel 336 fluidly connected to the remover 330 and spaced apart from the conveyor belt 110. The printing fluid collection vessel 336 may comprise a tank, a bucket, a cartridge, a foam, or the like. In the example shown in FIGS. 3A-C, a funnel 332 and a tubing 334 are employed and arranged to transfer the printing fluid removed by the remover 330 to the vessel 336. For example, at least a portion of the printing fluid on the conveyer belt 110 will be removed by the remover 330 and under gravitational force may be transferred through the funnel 332 and subsequently guided by the tubing 334 into the vessel 336. Although gravitational force may be used to transfer the printing fluid to the vessel 336, other ways of transferring the printing fluid could be employed. In one example, a pump or an actuator may be used, for example.

The use of a vessel 336 fluidly connected to the remover 330 enables printing fluid to be accumulated away from the conveyor belt 110. In certain examples, the vessel 336 is disposed such that it is easily accessible, for example, without involving opening the printing system 300 or removing any of the conveyor belt 110, remover 330, funnel 332, or tubing 334. Consequently, the printing fluid may be continuously collected by the printing fluid collector 100 in such a way that the vessel 336 can be emptied or replaced without user or service intervention of printing operations. Additionally, in some examples, the collection vessel 336 comprises a draining means which may, for example, be fluidly connected to an external waste drainage system thereby to provide a continuous removal of the printing fluid by the printing fluid collector 100. This may allow for the continuous removal of an effectively unlimited amount of printing fluid, without any user or service intervention and without involving cleaning or replacement of any parts, such that printing operations are not interrupted.

Figure 4:
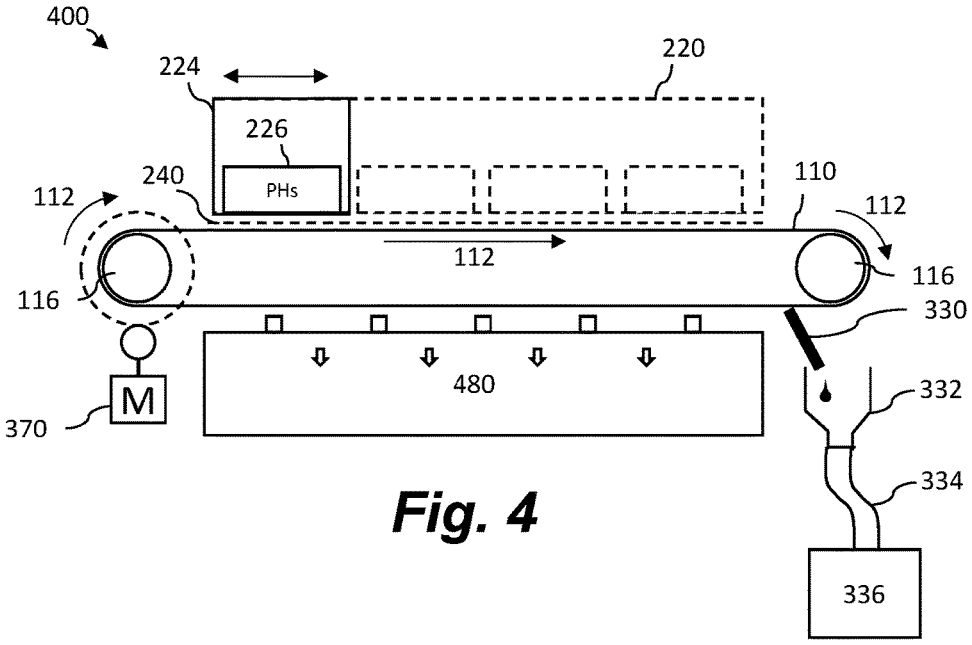
FIG. 4 is a schematic drawing showing a printing system according to a third example.

FIG. 4 illustrates a printing system 400 according to a second example. The printing system 400 may comprise some or all of the components described above in relation to FIGS. 3A-C.

The printing system 400 comprises a vacuum system 480 to generate a vacuum in relation to the print medium path 240, e.g. below one or more belts and/or one or more rollers of the conveyor mechanism 110. The air flow resulting from the vacuum generated by the vacuum system 480 (indicated by the four downward arrows) removes aerosols from the printing area which have been generated by the printing fluid during a print operation. Moreover, the vacuum system 480 reduces the risk of aerosols generated from the printing fluid clogging mechanical components of the printing system 400 or affecting electronic circuits within the printing system 400. Although the vacuum system 480 is depicted as below the conveyor belt 110 in FIG. 4, the vacuum system could be suitably arranged anywhere in close proximity to the printing area such that the vacuum system removes aerosols generated by the printing fluid, and actual implementations may vary from the example illustration shown. Additionally, in some cases, the material of the belt 110 may be selected to allow air to flow through the belt 110.

Figure 5:
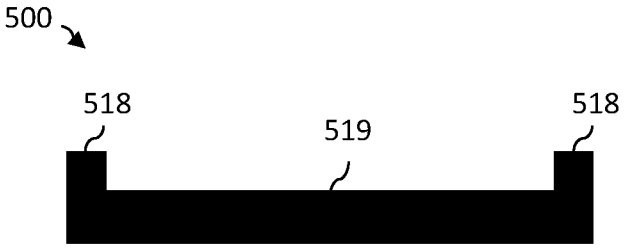
FIG. 5 is a cross-sectional schematic drawing showing a conveying section of a conveying mechanism according to an example.

FIG. 5 illustrates a cross-sectional view of conveying section 500 of the print fluid conveyor 101 according to an example. The conveying section 500 may be a cross-sectional portion of the belt 110 described above, for example. The conveying section 500 may comprise an inner portion 519 disposed between outer portions 518, wherein the outer portions have respective thicknesses each greater a thickness of the inner portion. In one example, the shape of the belt section 500 is a U-shape. In some cases, once the printing fluid is collected on the conveyor belt 110 it may "roll" or traverse the surface of the belt 110. Therefore, by having the thicknesses of the belt 110 arranged in this way the printing fluid may be prevented from rolling off the edges of the belt 110 and contaminating or clogging mechanical or electrical components of the printing system. In one case, the thickness of the belt section 500 is arranged in such a way that the change in thickness from the outer portion to the inner portion is gradual, so that when the printing fluid is collected on the belt 110 it migrates towards the inner portion. In one case, the shape of the printing fluid remover 330 may be arranged to be suitable for the shape of the cross-section of the belt section 500 such that contact between the remover 330 and the belt 110 is maximized. In this way, the amount of printing fluid which is removed by the remover 330 may be optimized. In one case, the belt may be flat, having an equal thickness across the inner and outer portions.

As described above, the print fluid conveyor 101 of FIGS. 1-4 may be removable from the printing system 200, 300, 400. This may enable it to be replaced with, for example, a solid print zone. This provides a versatile printing system for high quality printing on both porous and non-porous print media.

The term "solid print zone" as used herein refers to any solid component which can be placed along the print medium path 240 such that the print medium 341 passes between the printing fluid dispenser and the solid print zone. The solid print zone may also provide support to the print medium as it passes along the print medium path 240. In some examples, the solid print zone will have holes in it allowing for it to be paired with the vacuum system to retain the print medium on the print medium path 240 during the print operation. This prevents the print medium from rising up and touching the print heads 226, which may otherwise result in staining or contamination of the print medium.

The print fluid conveyor 101 in FIGS. 1-4 shows an example where one conveyor belt 110 is employed. However, the print fluid conveyor 101 may comprise more than one conveying portion, for example a plurality of conveyor belts in series. In certain cases, multiple print fluid removers 330 may also be used. In some examples, wherein the print fluid conveyor 101 is removable, multiple conveying portions allow for easier handling of the printing fluid collector during removal, replacement, or otherwise, and involving the handling of smaller component parts which are easier to manage for the user. In addition, this reduces the risk of damage to the printing fluid collector 100 or the printing system 200, 300, 400 during handling.

Figure 6:
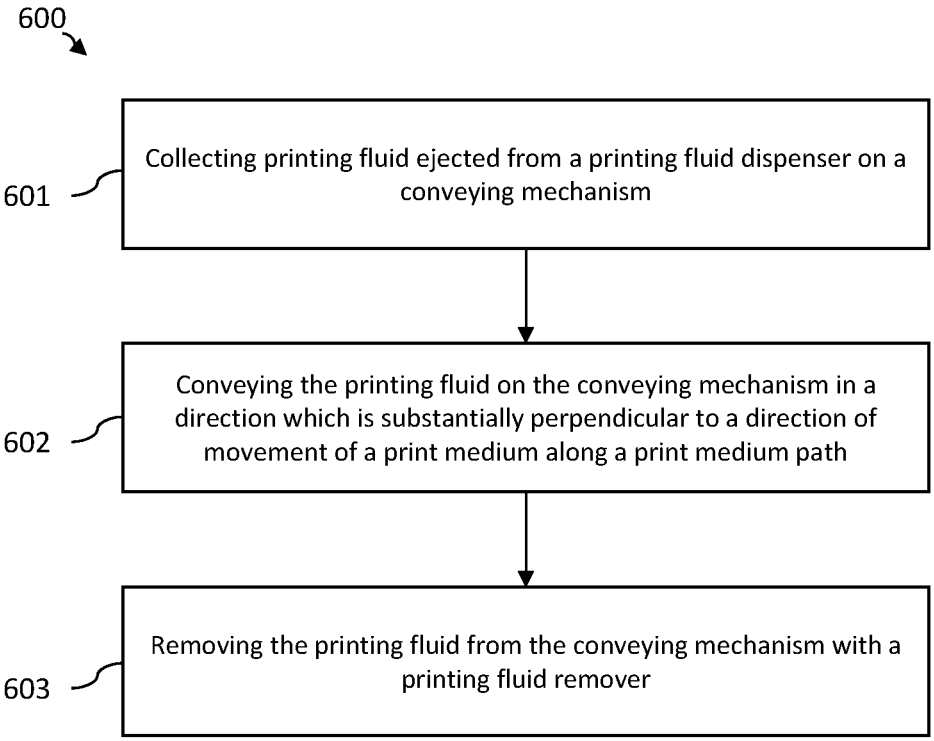
FIG. 6 is a flow diagram showing a method of collecting printing fluid according to an example.

FIG. 6 shows a method 600 of collecting printing fluid. The method may be performed by a printing fluid collector 100 as described above. The method may be performed during a print operation of a printing system as described above, for example. The method comprises at block 601 collecting a printing fluid ejected from a printing fluid dispenser on a print fluid conveyor 101. At block 602, the printing fluid collected at block 601 is conveyed on the print fluid conveyor 101 in a direction which is substantially perpendicular to a direction of movement of a print medium along a print medium path. At block 603, the printing fluid is removed from the print fluid conveyor with a printing fluid remover.

The preceding description has been presented to illustrate and describe examples of the principles described. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. A printing fluid collector comprising:

a conveying mechanism for collecting printing fluid ejected from a printing fluid dispenser; and a connecting means for connecting the conveying mechanism to a printing system in an orientation such that the conveying mechanism is to collect printing fluid ejected from the printing fluid dispenser, while a print medium is passing under a print head, in a direction which is substantially perpendicular to a direction of movement of the print medium along a print medium path, wherein a path from the conveying mechanism to a printing fluid collection vessel is substantially perpendicular to the direction of movement of the print medium along the print medium path.

2. The printing fluid collector of claim 1, comprising a printing fluid remover to remove printing fluid from the conveying mechanism.

3. The printing fluid collector of claim 2, comprising the printing fluid collection vessel fluidly connected to the printing fluid remover and disposed spaced apart from the conveying mechanism.

4. The printing fluid collector of claim 1, wherein the conveying mechanism has a width of less than 400 mm in a direction substantially perpendicular to a conveying direction of the conveying mechanism.

5. The printing fluid collector of claim 1, wherein the conveying mechanism comprises a belt comprising an inner portion disposed between outer portions, the outer portions having respective thicknesses each greater than a thickness of the inner portion.

6. The printing fluid collector of claim 1, wherein the connecting means is to removably connect the conveying mechanism to the printing system.

7. The printing fluid collector of claim 1 wherein the conveying mechanism comprises a plurality of conveying portions positioned in series.

8. A printing system comprising:

a first conveying mechanism to convey a printing medium along a print medium path;

a printing fluid dispenser; and a second conveying mechanism to collect printing fluid ejected from the printing fluid dispenser, while the printing medium is passing under a print head, in a direction which is substantially perpendicular to a direction of movement of the printing medium along the print medium path, wherein a path from the second conveying mechanism to a printing fluid collection vessel is substantially perpendicular to the direction of movement of the printing medium along the print medium path, wherein the print medium path is disposed between the printing fluid dispenser and the second conveying mechanism and spaced apart from the second conveying mechanism.

9. The printing system of claim 8 wherein the second conveying mechanism is to convey the printing fluid in a direction which is substantially perpendicular to the direction of movement of the printing medium along the print medium path.

10. The printing system of claim 8, comprising a vacuum system.

11. The printing system of claim 8, comprising:

a printing fluid remover to remove printing fluid from the second conveying mechanism; and the printing fluid collection vessel fluidly connected to the printing fluid remover and disposed spaced apart from the second conveying mechanism.

12. The printing system of claim 8, wherein the printing fluid dispenser is to dispense printing fluid to the print medium in a print zone having a first length along a direction of movement of the printing medium along the print medium path, and the second conveying mechanism has a width less than twice the first length.

13. The printing system of claim 8, wherein the print medium path is spaced apart from the second conveying mechanism by a distance of less than 5 mm.

14. A method of collecting printing fluid, the method comprising:

collecting, in a direction which is substantially perpendicular to a direction of movement of a print medium along a print medium path, printing fluid ejected from a printing fluid dispenser on a conveying mechanism, while the print medium is passing under a print head;

conveying the printing fluid on the conveying mechanism, wherein a path from the conveying mechanism to a printing fluid collection vessel is substantially perpendicular to the direction of movement of the print medium along the print medium path; and removing the printing fluid from the conveying mechanism with a printing fluid remover.

15. The method of claim 14, further comprising:

collecting printing fluid in the collection vessel fluidly connected to the printing fluid remover, the collection vessel disposed spaced apart from the conveying mechanism.

* * * * *